US011041607B1

(12) United States Patent
Oross et al.

(10) Patent No.: US 11,041,607 B1
(45) Date of Patent: Jun. 22, 2021

(54) APPARATUSES AND METHODS FOR ACCESSING AND CONCEALING LUMINAIRE MOUNTING COMPARTMENTS

(71) Applicant: RAB Lighting Inc., Northvale, NJ (US)

(72) Inventors: Glen Oross, Northvale, NJ (US); Jiang Hu, Ningbo (CN); Zhangyong Ying, Ningbo (CN)

(73) Assignee: RAB Lighting Inc., Northvale, NJ (US)

( * ) Notice: Subject to any disclaimer, the term of this patent is extended or adjusted under 35 U.S.C. 154(b) by 0 days.

(21) Appl. No.: 16/800,692

(22) Filed: Feb. 25, 2020

(51) Int. Cl.
*F21V 15/01* (2006.01)
*F21V 23/06* (2006.01)
*F21S 8/00* (2006.01)

(52) U.S. Cl.
CPC ..... *F21V 15/012* (2013.01); *F21S 8/033* (2013.01); *F21V 23/06* (2013.01)

(58) Field of Classification Search
CPC ..... F21V 15/012; F21V 23/06; F21V 8/033; F21V 15/01; F21V 7/0008; F21V 17/107; F21V 21/02; F21V 21/30; F21V 23/009; F21V 33/004; F21S 4/20; F21S 8/033; F21W 2131/302; F21Y 2103/10; A45D 42/10; A45D 42/16; A45D 33/32; A47B 67/005
See application file for complete search history.

(56) References Cited

U.S. PATENT DOCUMENTS 1,773,684 A * 8/1930 Kolber ..... A47B 67/005 312/198
D114,805 S 1/1939 Brooks
2,525,537 A 10/1950 Fletcher
2,677,751 A * 5/1954 Marchand ..... A47B 67/005 362/129
3,064,851 A 11/1962 Guigli
D202,803 S 11/1965 Wince
3,459,936 A 8/1969 Miller
3,697,743 A 10/1972 Eargle
(Continued)

FOREIGN PATENT DOCUMENTS

CA 2979652 3/2019
JP 2014206580 A 10/2014
(Continued)

*Primary Examiner* — Peggy A Neils
(74) *Attorney, Agent, or Firm* — Frost Brown Todd LLC; Dennis S. Schell; Kevin C. Oschman

(57) ABSTRACT

Apparatuses and methods for accessing luminaire mounting and/or electrical connection compartments and components are disclosed. Embodiments include a front reflective door pivotally attached to a luminaire housing with a closed position covering an opening to the mounting access compartment and an open position allowing easy user access to the mounting feature(s) in the mounting access compartment. In some embodiments the door forms an exterior surface of the lighting fixture, while in additional embodiments the luminaire's light source is mounted on the luminaire housing and not on the door. In still further embodiments the light source is located externally to the mounting access compartment so that the light source is outside the door when the door is closed. In yet further embodiments the free end of the door is adjacent the light source while the pivoting end of the door is located away from the light source.

20 Claims, 7 Drawing Sheets

(56) References Cited

U.S. PATENT DOCUMENTS

| | | | | |
|---|---|---|---|---|
| 3,883,732 | A | 5/1975 | Peterson et al. | |
| 4,488,205 | A | 12/1984 | Quiogue | |
| 4,599,684 | A | 7/1986 | Lee | |
| 4,638,414 | A | 1/1987 | de Vos et al. | |
| 4,752,863 | A * | 6/1988 | Parrott | A47G 1/00 312/224 |
| 5,521,806 | A | 5/1996 | Hutzel et al. | |
| D440,683 | S | 4/2001 | Guercio | |
| 6,210,019 | B1 | 4/2001 | Bobrick | |
| 6,932,488 | B1 * | 8/2005 | Horn | A47G 1/02 362/128 |
| 7,150,542 | B1 | 12/2006 | Russello | |
| D569,029 | S | 5/2008 | Guercio | |
| 7,513,633 | B2 * | 4/2009 | Ermeti | F21V 21/406 362/84 |
| 7,874,709 | B1 | 1/2011 | Beadle | |
| 8,777,460 | B2 * | 7/2014 | Newton | B23P 11/00 362/368 |
| 9,188,294 | B1 | 11/2015 | Bryant et al. | |
| 9,447,949 | B2 | 9/2016 | Doust | |
| 9,869,457 | B1 * | 1/2018 | Lin | F21S 8/033 |
| 9,874,320 | B2 | 1/2018 | Price et al. | |
| D815,331 | S | 4/2018 | Yang | |
| D833,055 | S | 11/2018 | Deng | |
| 10,190,750 | B1 | 1/2019 | Clements et al. | |
| 10,267,499 | B2 * | 4/2019 | Zhou | F21V 17/107 |
| 10,851,955 | B2 * | 12/2020 | Duckworth | F21V 17/107 |
| 2007/0086198 | A1 | 4/2007 | Wilson et al. | |
| 2007/0091596 | A1 | 4/2007 | Grossman et al. | |
| 2008/0043467 | A1 | 2/2008 | Wilcox et al. | |
| 2014/0146542 | A1 | 5/2014 | Seward et al. | |
| 2014/0268759 | A1 | 9/2014 | Brown et al. | |
| 2015/0167936 | A1 | 6/2015 | Yong | |
| 2015/0308667 | A1 | 10/2015 | Corkill | |
| 2016/0003455 | A1 | 1/2016 | Muchandi et al. | |
| 2016/0061413 | A1 | 3/2016 | Hedberg | |
| 2016/0084447 | A1 | 3/2016 | Scribante et al. | |
| 2016/0091158 | A1 | 3/2016 | Scribante et al. | |
| 2016/0102825 | A1 | 4/2016 | Scribante et al. | |
| 2016/0312989 | A1 | 10/2016 | Tiwary et al. | |
| 2017/0038058 | A1 * | 2/2017 | Cano | F21V 33/0012 |
| 2018/0156446 | A1 | 6/2018 | Ryder et al. | |
| 2018/0195673 | A1 | 7/2018 | Adams et al. | |

FOREIGN PATENT DOCUMENTS

| | | |
|---|---|---|
| WO | 1993015355 | 8/1993 |
| WO | 1996033368 | 10/1996 |
| WO | 2007120382 | 10/2007 |

* cited by examiner

APPARATUSES AND METHODS FOR ACCESSING AND CONCEALING LUMINAIRE MOUNTING COMPARTMENTS

This application is a continuation-in-part of U.S. application Ser. No. 29/720,261, filed Jan. 10, 2020, the entirety of which is hereby incorporated herein by reference. Any disclaimer that may have occurred during the prosecution of the above-referenced application is hereby expressly rescinded.

FIELD

Embodiments of this disclosure relate generally to lighting fixtures, also referred to as luminaires, and to a lighting fixture with a mounting and/or electrical connection compartment that is easily opened and made accessible, and easily closed to conceal the mounting and/or electrical

BACKGROUND

Luminaires frequently require mounting to a surface (for example, a wall) and connection to a power source (for example, wall power) before they are operationally ready. Many luminaire designs require disassembly of at least a portion of the luminaire in order to mount the luminaire to the surface and connect the luminaire to the power source, if required. It was realized by the inventors of the current disclosure that this disassembly frequently presents problems for the person mounting the luminaire and connecting the luminaire to a power source, and that improvements in the mechanisms and methods to mount luminaires to mounting surfaces, and connect the luminaire to a power source if required, are needed. Certain preferred features of the present disclosure address these and other needs and provide other important advantages.

SUMMARY

Embodiments of the present disclosure provide improved apparatuses and methods for accessing and concealing luminaire mounting compartments and hardware.

In accordance with various aspects of different embodiments of the present disclosure are expressed in paragraphs A and B, as follows:

A. One embodiment of the present disclosure includes a lighting fixture, comprising a housing defining a mounting access compartment and at least one mounting feature located within the mounting access compartment, the mounting access compartment defining an opening allowing user access to the at least one mounting feature; a reflective door pivotally mounted to the housing; a light source mounted to the housing and externally to the reflective door; and a reflective door pivotally attached to the housing and defining two positions, a closed position wherein the reflective door covers the opening to the mounting access compartment and forms an exterior surface of the lighting fixture, and an open position wherein the reflective door allows user access to the mounting feature in the mounting access compartment.

B. Another embodiment of the present disclosure includes a lighting fixture, comprising a housing defining a mounting access compartment and at least one mounting feature located within the mounting access compartment, the mounting access compartment defining an opening allowing user access to the at least one mounting feature; a reflective door pivotally attached to the housing and defining two positions, a closed position wherein the reflective door covers the opening to the mounting access compartment, and an open position wherein the reflective door allows user access to the at least one mounting feature in the mounting access compartment; and a light source mounted to the housing externally to the mounting access compartment and externally to the door.

In accordance with other aspects of embodiments of the present disclosure, disclosed are the features described in any of the previous statements A and B, as combined with (i) one or more of the previous statements A or B, (ii) one or more of the following aspects in the Summary, or (iii) one or more of the previous statements A and B and one or more of the following aspects in the Summary.

The door defines a pivoting end adjacent the pivotal attachment between the door and the housing and the door defines a free end located on the opposite side of the door from the pivotal attachment, and wherein the pivoting end is located farther from light source than the free end.

The free end of the door moves from one side of the light source to another side of the light source when the door is moved from the closed to the open position.

The free end of the door is immediately adjacent the light source when the door is in the closed position.

The light source is mounted externally to the mounting access compartment.

The opening to the mounting access compartment is oriented to face away from a mounting surface to which the lighting fixture is mounted.

The door blocks viewing of the mounting access compartment when the door is in the closed position.

The pivotal attachment between the door and the housing includes a hinge.

Gravity holds the door in the open position.

The door is approximately one-half of front surface area of the lighting fixture.

The door forms an exterior surface of the lighting fixture when closed.

This summary is provided to introduce a selection of the concepts that are described in further detail in the detailed description and drawings contained herein. This summary is not intended to identify any primary or essential features of the claimed subject matter. Some or all of the described features may be present in the corresponding independent or dependent claims, but should not be construed to be a limitation unless expressly recited in a particular claim Each embodiment described herein does not necessarily address every object described herein, and each embodiment does not necessarily include each feature described. Other forms, embodiments, objects, advantages, benefits, features, and aspects of the present disclosure will become apparent to one of skill in the art from the detailed description and drawings contained herein. Moreover, the various apparatuses and methods described in this summary section, as well as elsewhere in this application, can be expressed as a large number of different combinations and subcombinations. All such useful, novel, and inventive combinations and subcombinations are contemplated herein, it being recognized that the explicit expression of each of these combinations is unnecessary.

BRIEF DESCRIPTION OF THE DRAWINGS

Some of the figures shown herein may include dimensions or may have been created from scaled drawings. However, such dimensions, or the relative scaling within a figure, are by way of example, and not to be construed as limiting.

DETAILED DESCRIPTION OF THE ILLUSTRATED EMBODIMENTS

Figure 1:
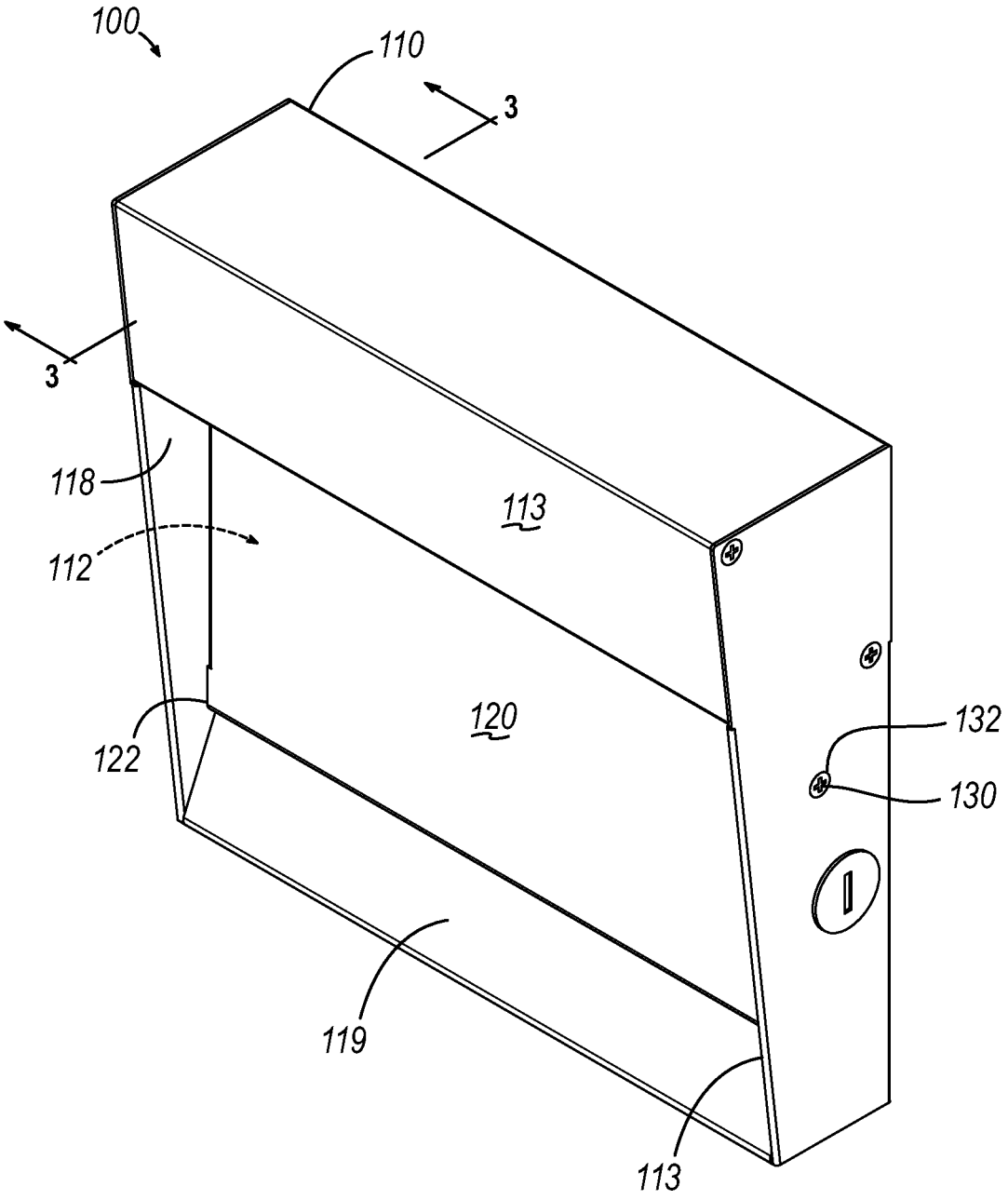
FIG. 1 is perspective view of a lighting fixture according to one embodiment of the present disclosure with a door in the closed position.

For the purposes of promoting an understanding of the principles of the disclosure, reference will now be made to one or more embodiments, which may or may not be illustrated in the drawings, and specific language will be used to describe the same. It will nevertheless be understood that no limitation of the scope of the disclosure is thereby intended; any alterations and further modifications of the described or illustrated embodiments, and any further applications of the principles of the disclosure as illustrated herein are contemplated as would normally occur to one skilled in the art to which the disclosure relates. At least one embodiment of the disclosure is shown in great detail, although it will be apparent to those skilled in the relevant art that some features or some combinations of features may not be shown for the sake of clarity.

Embodiments of the present disclosure provide a lighting fixture that is easily mounted to a mounting surface, such as a wall, and includes an access panel that covers the area where the electrician mounts the lighting fixture to the wall and/or makes the electrical connections, then closes to present a finished look and can assist in directing the light from the light source(s) into the room or area surrounding the lighting fixture.

Figure 2:
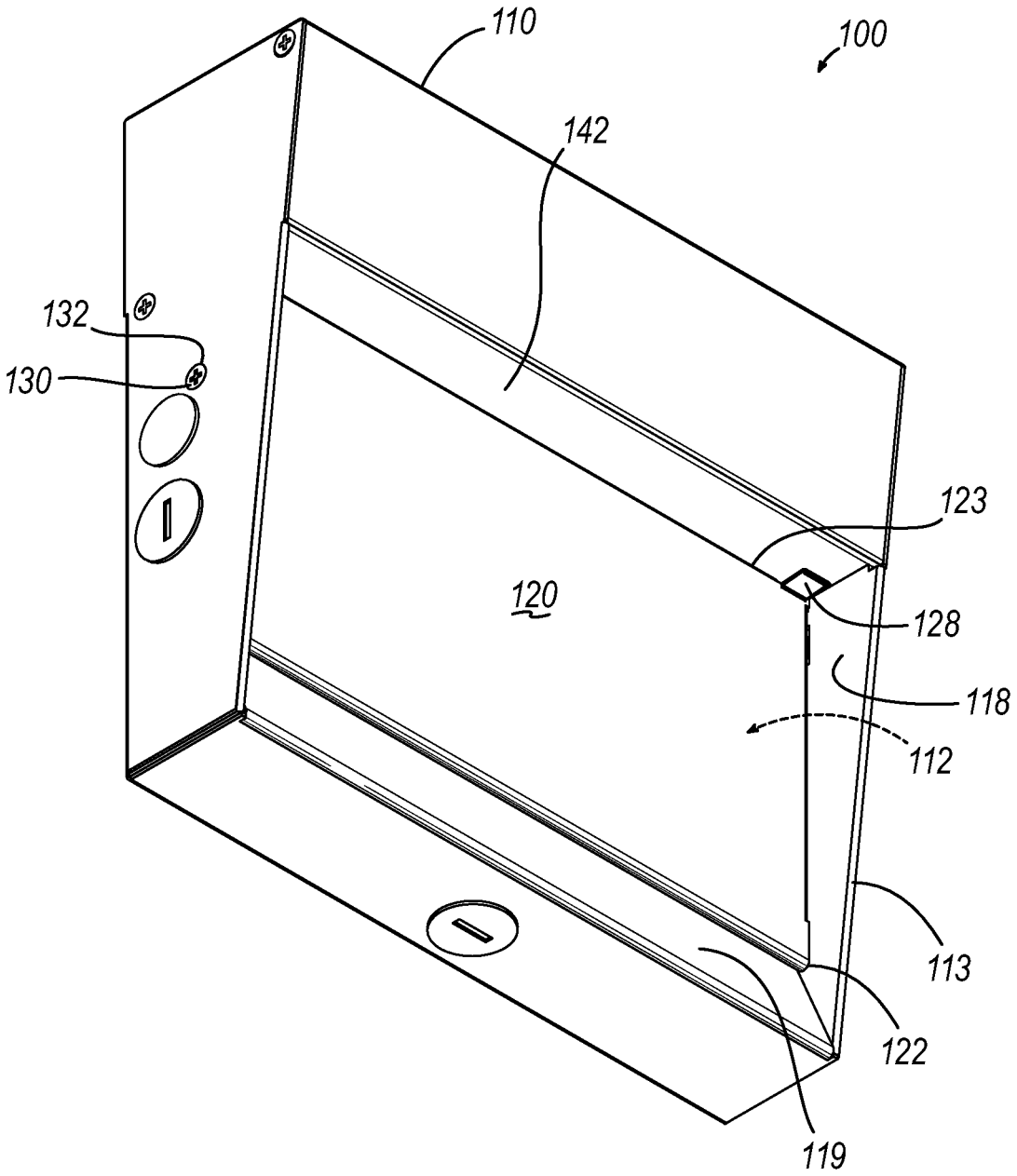
FIG. 2 is an alternate perspective view of the lighting fixture shown in FIG. 1.
Figure 3:
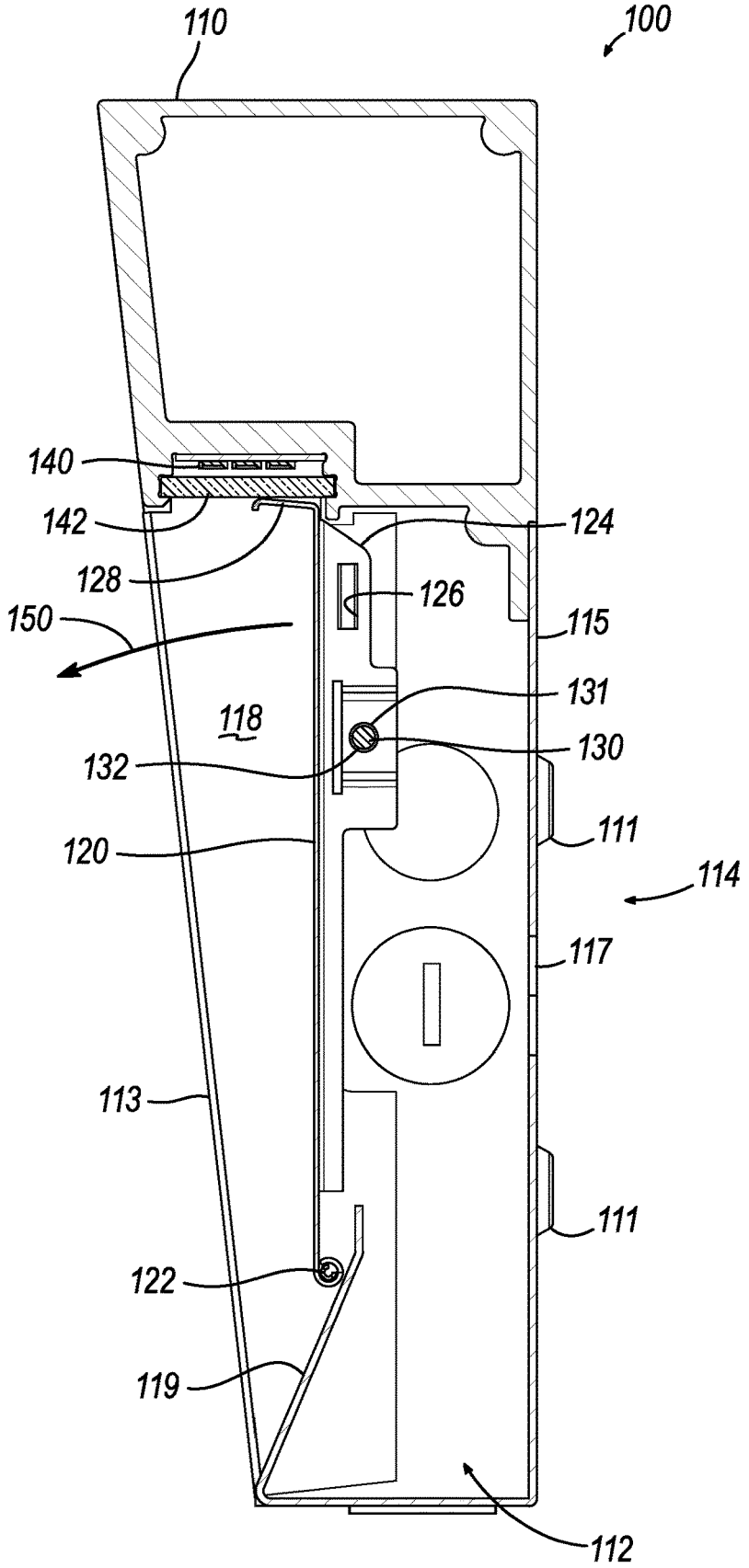
FIG. 3 is a sectional view of the lighting fixture shown in FIG. 1 as viewed along 3-3.

Depicted in FIGS. 1-3 is a lighting fixture 100 according to one embodiment of the present disclosure. Lighting fixture 100 includes a housing 110, a door 120 and one or more light sources 140. The housing 110 includes a mounting and/or electrical access compartment 112 (see, FIG. 3) that encloses and/or conceals one or more mounting features for mounting the lighting fixture 100 to a mounting surface (such as a wall) and/or connecting the light source 140 to an electrical power source (such as electrical power wires contained within the wall). In the illustrated embodiment, the example mounting and/or connection features 114 include apertures 117 and mounting surface contact portions 111 (see, for example, the raised features on the back of housing 110 in FIGS. 5-7), although other embodiments include other mounting and/or connection features such as bolts, pins, flanges, threaded receptacles, wires, and screws.

The mounting and/or electrical access compartment 112 includes an opening 116 (see, for example, FIG. 4) oriented in a direction where a user, such as an electrician, can easily gain access to the one or more mounting and/or electrical connection features 114 within the mounting and/or electrical access compartment 112, and typically faces in a direction that would be readily viewable by an observer in proximity to the lighting fixture 100 when the lighting fixture 100 is operating. For example, in the illustrated embodiment the opening 116 to the mounting and/or electrical access compartment 112 faces the front of the luminaire 100, permitting access to the mounting and/or electrical access compartment 112 from the front of the luminaire 100.

The door 120 defines a surface that closes the opening 116 of the mounting and/or electrical access compartment 112 and inhibits, if not prevents, people from seeing inside the mounting and/or electrical access compartment 112 and/or accessing the inside of the mounting and/or electrical access compartment 112. The door 120 is pivotally connected to the housing 110 at one or more pivot positions 122. In the illustrated embodiment, a hinge (for example, a pin and barrel hinge) is used for pivotally connecting the door 120 to the housing 110, although other types of pivoting arrangements that allow the door 120 to open and close (such as, linkages, flexures, compound hinges and ball and socket joints) may be used. The pivoting connection between the door 120 and the housing 110 permits the door 120 to move from a closed position where the mounting and/or electrical access compartment 112 and the mounting and/or electrical connection features 114 are concealed from view and inaccessible from outside the luminaire 100 to an open position where the mounting and/or electrical access compartment 112 and the mounting and/or electrical connection features 114 are viewable and accessible from outside the luminaire 100.

Figure 4:
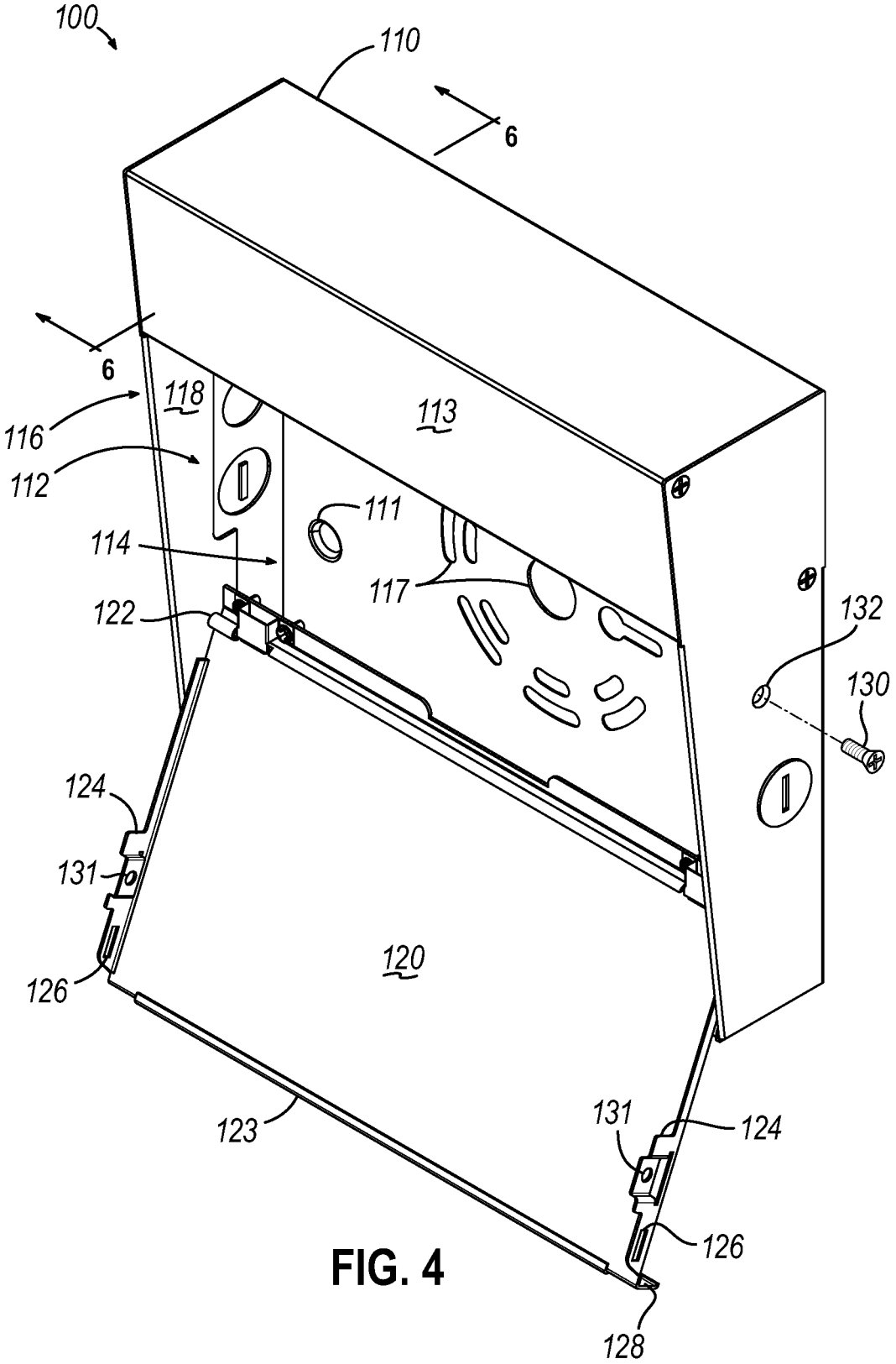
FIG. 4 is perspective view of the lighting fixture shown in FIG. 1 with the door in the open position.
Figure 5:
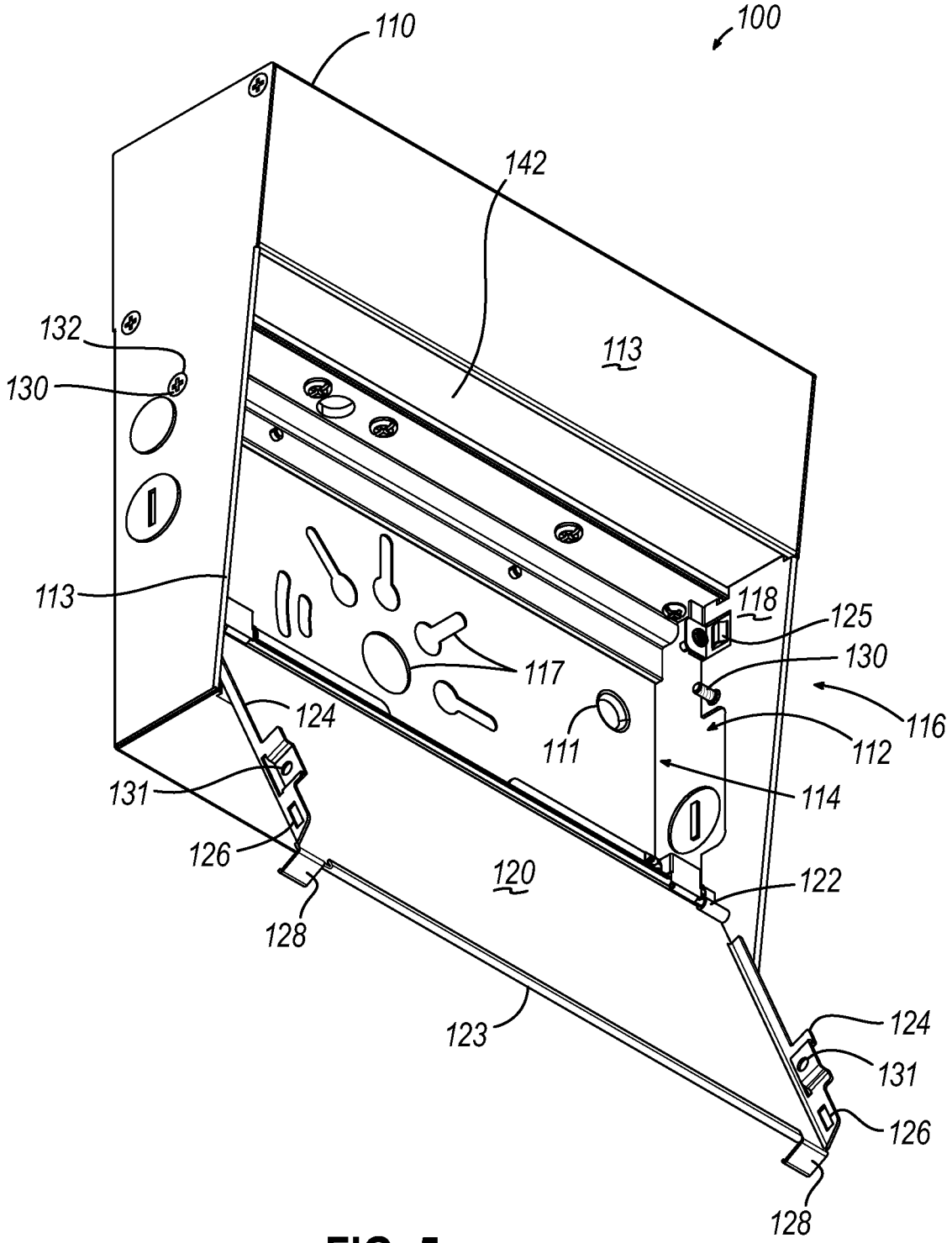
FIG. 5 is an alternate perspective view of the lighting fixture shown in FIG. 4.
Figure 6:
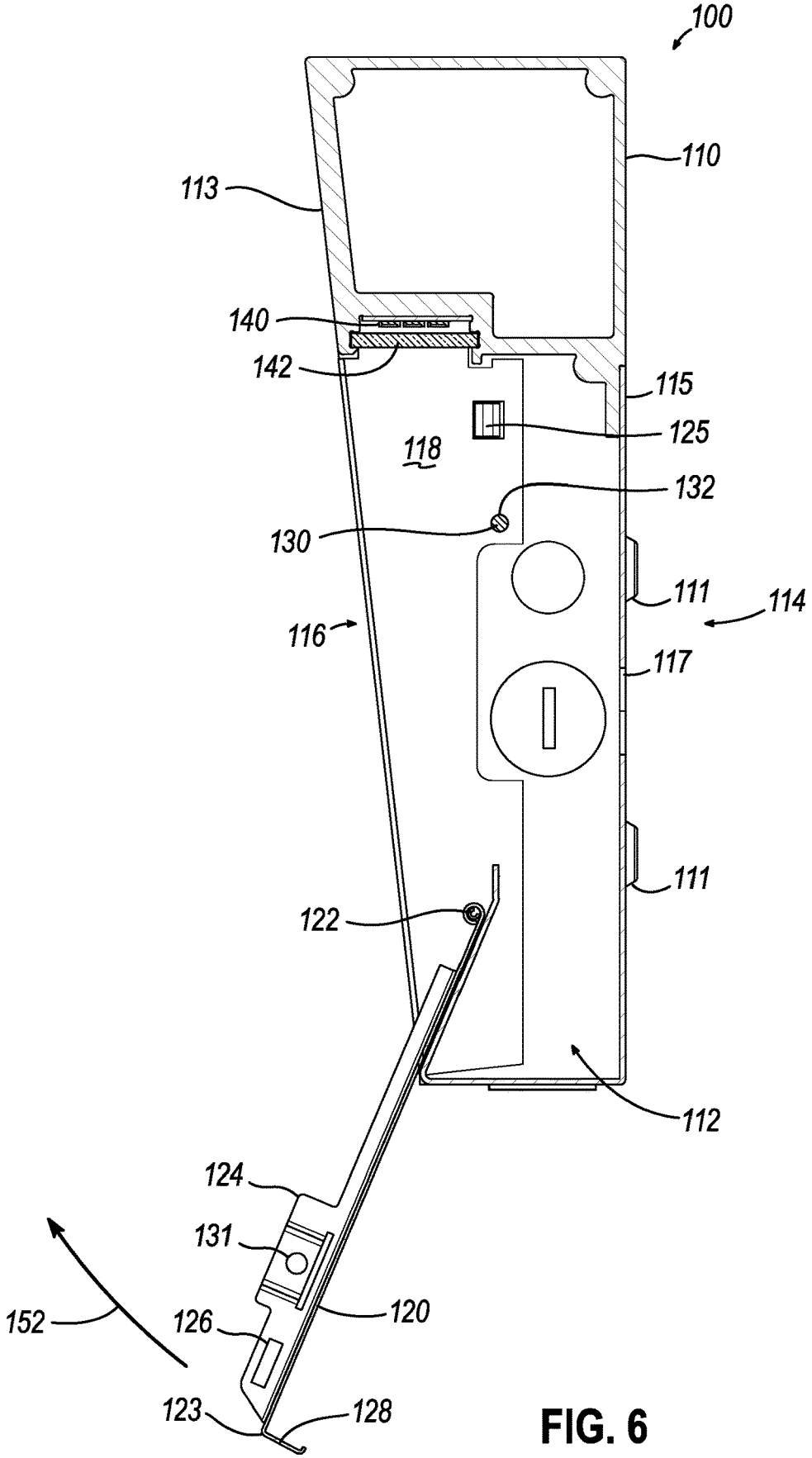
FIG. 6 is a sectional view of the lighting fixture shown in FIG. 4 as viewed along 6-6.
Figure 7:
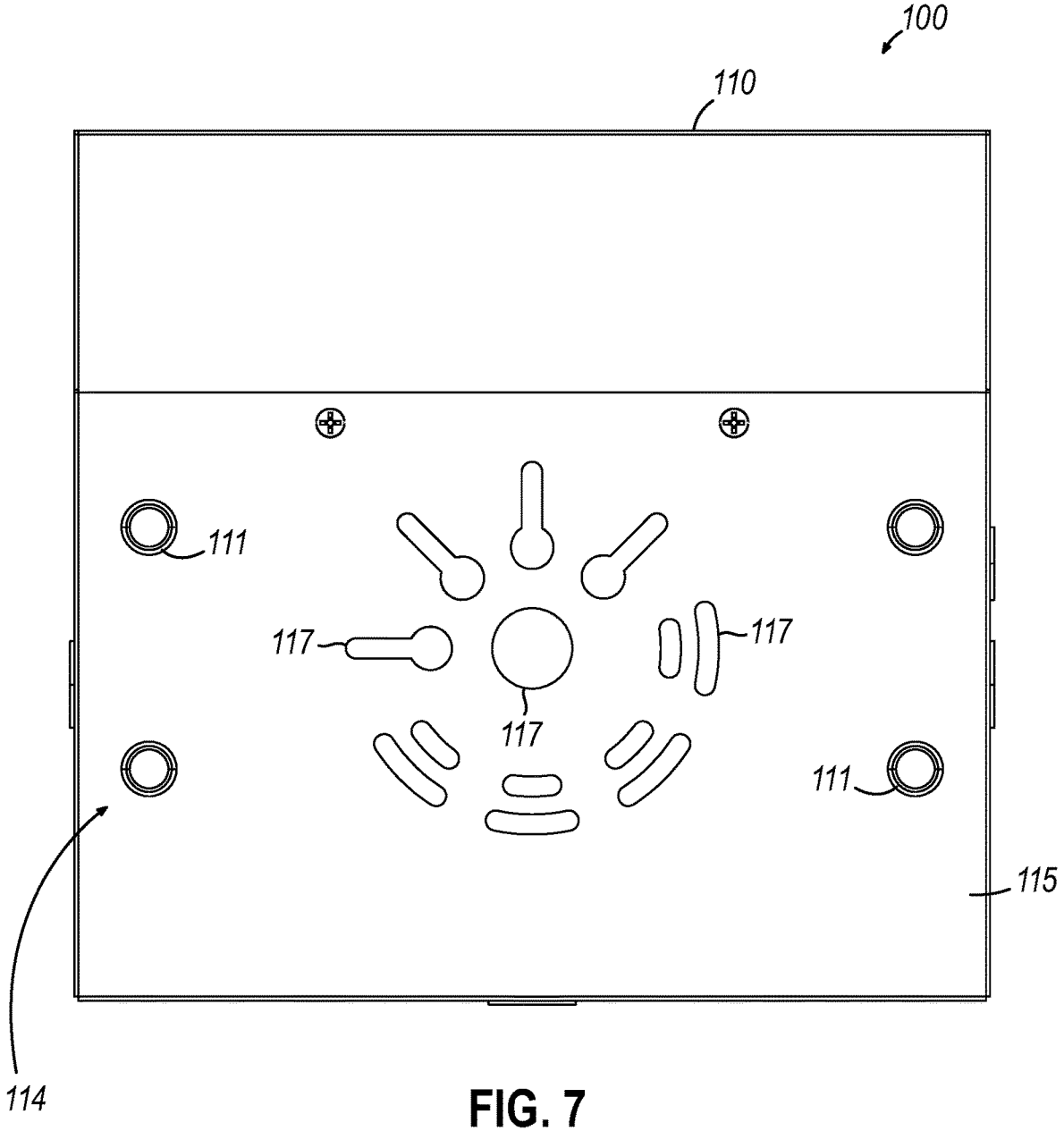
FIG. 7 is a rear elevational view of the lighting fixture shown in FIG. 1.

Depicted in FIGS. 4-6 is the lighting fixture 100 with the door 120 in one example of an open position, namely a fully open position where the door 120 cannot open farther without damaging the door 120, the hinge mechanism, or the housing 110. The free end 123 of the door 120 is opposite the end of the door 120 that is pivotally attached to the housing 110 at the one or more pivot positions 122.

The door 120 can also include one or more securement features (such as one or more flanges 124) to help maintain the door 120 in the closed position. For example, the one or more securement features may fit snugly within side surfaces 118 so that when the door 120 is closed the friction between the one or more securement features and the side surfaces 118 maintain door 120 in the closed position. As another example, one or more flexible members (such as a flat, cantilever spring 125), on the door 120 and/or on the housing 110, may be included to increase the amount of force required to open the door 120 from its closed position. As yet another example, one or more flexible member receptacles (for example, one or more apertures 126) may be included with either the door 120 and/or the housing 110 to receive the one or more springs 125 and increase the amount of force required to open the door 120 from its closed position. In the illustrated embodiment, the spring(s) 125 are attached to the housing 110 to interact with the spring member receptacle(s) 126 on door 120.

The door 120 may also include one or more handles 128 to assist a user in opening the door 120. For example, in the illustrated embodiment there are two handles 128 on opposite sides of the free end 123 of the door 120. Each of the handles 128 include small flanges on the unsupported end of the handle 128 that makes it easier for a user to grasp the handle 128 using a finger or a tool so that sufficient force can be applied to the free end 123 of the door 120 to move door 120 away from the closed position.

Embodiments of lighting fixture 100 may also include a locking mechanism that inhibits a user from opening the door 120 even when using one or more handles 128, and in certain embodiments can result in damage to the lighting fixture 100 if the door 120 is opened while the locking mechanism has locked the door 120 in the closed position. For example, the lighting fixture 100 may include one or more apertures 132 in housing 110 and one or more locking member receptacles 131. The one or more apertures 132 in housing 110 and the one or more locking member receptacles 131 in door 120 accept a locking member 130 extending through both aperture 132 and the corresponding locking member receptacle 131 to secure the door 120 in the closed position. The locking member 130 may take the form of a pin, bolt, screw or other device that will securely hold the door 120 in the closed position until sufficient force is applied to damaged locking member 130. Other embodiments include other forms of locking mechanisms, such as those with one or more spring clips that engage when the door 120 is closed and require a tool to release in order to open the door 120.

Depicted in FIGS. 2-3 and 5-6 are the example locations for one or more light sources 140 and, optionally, one or more lenses 142. In the illustrated embodiment the one or more light sources 140 are positioned adjacent the free end 123 of the door 120 (or alternatively being positioned immediately adjacent the free end 123 of the door 120 with the door 120 appearing to an observer to be almost touching, if not actually touching, one or more of the light sources 140 when door 120 is closed), although in alternate embodiments light sources may be positioned on other locations, such as adjacent (or immediately adjacent) the pivoting end of the door 120, which may include positioning on one or more side surfaces 118. One or more lenses 142 may be used or for various purposes, such as to protect the one or more light sources 140 from damage and/or create a pleasing aesthetic appearance for the lighting fixture 100.

When the door 120 is in the closed position, such as in the example embodiments depicted in FIGS. 2 and 3, the one or more light sources 140 are positioned where light emanating from the one or more light sources 140 is external to the door 120 when the door 120 is in the closed position allowing light to illuminate the area surrounding the lighting fixture 100. Due to the positioning of the light sources 140, none of the light emanating from the one or more light sources 140 is directed into the mounting and/or electrical access compartment 112, although in some alternate embodiments some light emanating from the one or more light sources 140 can illuminate the inside of the mounting and/or electrical access compartment 112.

In some embodiments, such as the ones depicted in FIGS. 1-6, the door 120 includes a highly reflective surface (for example, a surface that is specularly reflective at the incident angles of light emanating from the one or more light sources 140) facing outward from the lighting fixture, all or nearly all of the light impinging upon the door 120 is redirected into the area surrounding the lighting fixture 100. In still other embodiments, the outwardly facing surface of door 120 produces diffuse reflection of the light emanating from the one or more light sources 140. The side surfaces 118 and/or the bottom surface 119 of the housing 110 may also be reflective and assist in outwardly reflecting the light emanating from the one or more light sources 140 of the lighting fixture 100 and into the area surrounding the lighting fixture 100.

Turning to the sectional views of the lighting fixture 100 depicted in FIGS. 3 and 6, the door 120 is oriented parallel to the back surface 115 of the housing 110 when the door 120 is in the closed position. When in the open position, the door 120 lies against the bottom surface 119 of the housing 110 and remains in the open position unless an external force is applied to the door 120. The front surface 113 of housing 110 can define a plane (as depicted) and is optionally arranged to be non-parallel (inclined at an angle with respect to) the back surface 115. Having the front surface 113 of the lighting fixture 100 define a plane with the door 120 defining a different, non-parallel plane can have benefits in improving the overall appearance of the lighting fixture 100.

The one or more light sources 140 may be positioned at the thicker portion of the lighting fixture 100, in other words, where the front surface 113 and the rear surface 115 are located farther apart from one another, which in the illustrated embodiments is toward the top (upper portions) of the figures. The pivot position 122 where the door 120 pivots in relation to the housing 110 is located in the thinner portion of the lighting fixture 100, in other words, where the front surface 113 and the rear surface 115 are located closer together, which in the illustrated embodiments is toward the bottom (lower portions) of the figures. This arrangement allows the door 120 to remain generally vertical when closed and the one or more light sources 140 to extend outwardly from the closed door 120 and away from the mounting surface, which has advantages in allowing the light reflecting from the door 120 to be directed in a more generally downward direction (since the door 120 is vertically oriented) than embodiments where the bottom of door 120 (the pivoting end of the door 120 in the illustrated embodiments) is located farther from the mounting surface than the top of the door 120 (the free end 123 of the door 120 in the illustrated embodiments) when the door 120 is in the closed position. Having the one or more light sources 140 recessed under the upper portion of the luminaire 100 as shown in the illustrated embodiments can help reduce the appearance of hot spots near the one or more light sources.

The opening 116 to the mounting and/or access compartment 112 being located in front of the luminaire 100, the mounting and/or access compartment 112 is easy for the electrician to access. Moreover, with the access compartment potentially occupying a significant portion of the front of the luminaire 100, the access compartment is a substantial part of the aesthetic appearance of the luminaire 100. For example, in some embodiments the access compartment opening 116 and/or the door 120 comprises approximately half of the front surface area of luminaire 100, while in further embodiments the access compartment opening 116 and/or the door 120 comprises approximately 40% to 70% of the front surface area of luminaire 100, while in still further embodiments the access compartment opening 116 and/or the door 120 comprises approximately 55% of the front surface area of luminaire 100.

In some embodiments the opening is fairly shallow (from front to back) in comparison to the smallest dimension of the opening (the height of the opening in the illustrated embodiments), helping make the access compartment easy for the electrician to work in. For example, in some embodiments the depth (from front to back) of opening 116 is approximately 25% to 30% of the smallest dimension of the opening 116 (the height of opening 116 in the illustrated embodiments), while in further embodiments the depth (from front to back) of opening 116 is approximately 27% of the smallest dimension of the opening 116 (the height of opening 116 in the illustrated embodiments).

In use, a user (such as an electrician) can open the door 120 of the lighting fixture 100 and expose the mounting and/or electrical connection features 114 located within mounting and/or electrical access compartment 112. To open the door 120, the electrician can grasp the one or more handles 128 (if provided) with the electrician's hand (or a tool) and apply sufficient force in direction 150 to overcome the holding force between the door 120 and the housing 110, which in the illustrated embodiment will need to overcome the holding force between the flexible member receptacle (for example, aperture 126) on the door 120 and the flexible member (for example, spring member 125) on the housing 110.

In embodiments including one or more locking members 130, the user/electrician will remove the one or more locking members 130 from the locking member receptacle 131 in the door 120 and from the aperture 132 in the housing 110 before moving the door 120 in direction 150 (see FIG. 3) to open the door 120.

After opening the door 120, the user/electrician will have access to the mounting and/or electrical connection features 114 within the mounting and/or electrical connection compartment 112. The electrician can then install mounting hardware (if required) and mount the lighting fixture 100 to a mounting surface (such as a wall). If needed, the user/electrician can also connect electrical wiring associated with the mounting surface to the electrical components of the lighting fixture 100, such as the one or more lighting sources 140.

Once the lighting fixture 100 has been mounted and electrically connected (if needed) to the mounting surface, the electrician simply moves the door 120 in direction 152 (see FIG. 6) to close the mounting and/or electrical access compartment 112. Once door 120 is closed, the mounting and/or electrical access compartment 112 and the mounting and/or electrical connection features 114 are blocked from sight and from blocked from being accessed. The simple act of swinging the door 120 to the closed position finishes the installation and presents an aesthetically appealing luminaire where none of the mounting hardware or electrical connections are visible to a person viewing the installed luminaire 100.

The outward facing surface of the door 120 will typically be an aesthetically pleasing surface that reflects a substantial majority, if not all, of the light impinging upon the door 120 and assisting in the redirection of light emanating from the one or more light sources 140 into or in a desired direction.

If provided and if additional security is desired, the electrician can lock the door 120 by using a locking mechanism, such as inserting a locking member 130 through aperture 132 and locking member receptacle 131 to lock door 120 in place. Doing so increases the level of difficulty in opening door 120, such as by requiring a user to acquire a tool (such as a screwdriver to remove a locking member 130 in the form of a screw) to open the door 120, thereby increasing level of safety by inhibiting access to the electrical wiring and decreasing the ability for a user to tamper with the mounting and/or electrical connection hardware. This can have advantages in environments where the luminaire 100 is mounted in locations where children have access to luminaire 100.

Alternate embodiments include lighting fixtures with internal power sources, such as batteries, which only need to be mounted to a mounting surface and not connected to a power source associated with the mounting surface.

Any reference to "invention" within this document is a reference to an embodiment of a family of inventions, with no single embodiment including features that are necessarily included in all embodiments, unless otherwise stated. Furthermore, although there may be references to benefits or advantages provided by some embodiments, other embodiments may not include those same benefits or advantages, or may include different benefits or advantages. Any benefits or advantages described herein are not to be construed as limiting to any of the claims.

Likewise, there may be discussion with regards to "objects" associated with some embodiments of the present invention, it is understood that yet other embodiments may not be associated with those same objects, or may include yet different objects. Any advantages, objects, or similar words used herein are not to be construed as limiting to any of the claims. The usage of words indicating preference, such as "preferably," refers to features and aspects that are present in at least one embodiment, but which are optional for some embodiments.

Specific quantities (spatial dimensions, temperatures, pressures, times, force, resistance, current, voltage, concentrations, wavelengths, frequencies, heat transfer coefficients, dimensionless parameters, etc.) may be used explicitly or implicitly herein, such specific quantities are presented as examples only and are approximate values unless otherwise indicated. Discussions pertaining to specific compositions of matter, if present, are presented as examples only and do not limit the applicability of other compositions of matter, especially other compositions of matter with similar properties, unless otherwise indicated.

The term "and/or" as used herein is a function word indicating that the words or expressions combined by "and/or" can be taken together or individually. For example, "A and/or B" is equivalent to "A alone, B alone, or A and B together."

Reference systems that may be used herein can refer generally to various directions (e.g., upper, lower, forward and rearward), which are merely offered to assist the reader in understanding the various embodiments of the disclosure and are not to be interpreted as limiting. Other reference systems may be used to describe various embodiments, such as referring to the direction of projectile movement as it exits the firearm as being up, down, rearward or any other direction.

While examples, one or more representative embodiments and specific forms of the disclosure have been illustrated and described in detail in the drawings and foregoing description, the same is to be considered as illustrative and not restrictive or limiting. The description of particular features in one embodiment does not imply that those particular features are necessarily limited to that one embodiment. Some or all of the features of one embodiment can be used or applied in combination with some or all of the features of other embodiments unless otherwise indicated. One or more exemplary embodiments have been shown and described, and all changes and modifications that come within the spirit of the disclosure are desired to be protected.

Element Numbering

Table 1 includes element numbers and at least one word used to describe the member and/or feature represented by the element number. It is understood that none of the embodiments disclosed herein are limited to these descriptions, other words may be used in the description or claims to describe a similar member and/or feature, and these element numbers can be described by other words that would be understood by a person of ordinary skill reading and reviewing this disclosure in its entirety.

TABLE 1

| | |
|---|---|
| 100 | Lighting fixture |
| 110 | Housing |
| 111 | Mounting surface contact portion |
| 112 | Mounting and/or electrical access compartment |
| 113 | Front surface |
| 114 | Mounting and/or electrical connection features |
| 115 | Rear surface |
| 116 | Opening |
| 117 | Aperture |
| 118 | Side surface |
| 119 | Lower surface |
| 120 | Door |
| 122 | Pivot position |
| 123 | Free end |
| 124 | Flange |
| 125 | Flexible member |
| 126 | Flexible member receptacle |
| 128 | Handle |
| 130 | Locking member |
| 131 | Locking member receptacle |
| 132 | Aperture |
| 140 | Light source |
| 142 | Lens |
| 150 | Opening direction |
| 152 | Closing direction |

What is claimed is:

1. A lighting fixture, comprising:

a housing defining a mounting access compartment and at least one mounting feature located within the mounting access compartment, the at least one mounting feature for securing the housing to a mounting surface, the mounting access compartment defining an opening allowing user access to the at least one mounting feature;

a reflective door pivotally mounted to the housing; and a light source mounted to the housing and externally to the reflective door;

wherein the reflective door defines two positions, a closed position wherein the reflective door covers the opening to the mounting access compartment and forms an exterior surface of the lighting fixture, and an open position wherein the reflective door allows user access to the at least one mounting feature in the mounting access compartment.

2. The lighting fixture of claim 1, wherein the door defines a pivoting end adjacent the pivotal attachment between the door and the housing and the door defines a free end located on the opposite side of the door from the pivotal attachment, and wherein the pivoting end is located farther from light source than the free end.

3. The lighting fixture of claim 2, wherein the free end of the door moves from one side of the light source to another side of the light source when the door is moved from the closed to the open position.

4. The lighting fixture of claim 2, wherein the free end of the door is immediately adjacent the light source when the door is in the closed position.

5. The lighting fixture of claim 1, wherein the light source is mounted externally to the mounting access compartment.

6. The lighting fixture of claim 1, wherein the opening to the mounting access compartment is oriented to face away from a mounting surface to which the lighting fixture is mounted.

7. The lighting fixture of claim 1, wherein the door blocks viewing of the mounting access compartment when the door is in the closed position.

8. The lighting fixture of claim 1, wherein the pivotal attachment between the door and the housing includes a hinge.

9. The lighting fixture of claim 1, wherein gravity holds the door in the open position.

10. The lighting fixture of claim 1, wherein the door is approximately one-half of front surface area of the lighting fixture.

11. A lighting fixture, comprising:

a housing defining a mounting access compartment and at least one mounting feature located within the mounting access compartment, the at least one mounting feature for securing the housing to a mounting surface, the mounting access compartment defining an opening allowing user access to the at least one mounting feature;

a reflective door pivotally attached to the housing and defining two positions, a closed position wherein the reflective door covers the opening to the mounting access compartment, and an open position wherein the reflective door allows user access to the at least one mounting feature in the mounting access compartment; and a light source mounted to the housing externally to the mounting access compartment and externally to the door, wherein the light source is configured to direct a portion of the light to reflect from the reflective door.

12. The lighting fixture of claim 11, wherein the door defines a pivoting end adjacent the pivotal attachment between the door and the housing and the door defines a free end located on the opposite side of the door from the pivotal attachment, and wherein the pivoting end is located farther from light source than the free end.

13. The lighting fixture of claim 12, wherein the free end of the door moves from one side of the light source to another side of the light source when the door is moved from the closed to the open position.

14. The lighting fixture of claim 12, wherein the free end of the door is immediately adjacent the light source when the door is in the closed position.

15. The lighting fixture of claim 11, wherein the door forms an exterior surface of the lighting fixture when closed.

16. The lighting fixture of claim 11, wherein the opening to the mounting access compartment is oriented to face away from a mounting surface to which the lighting fixture is mounted.

17. The lighting fixture of claim 11, wherein the door blocks viewing of the mounting access compartment when the door is in the closed position.

18. The lighting fixture of claim 11, wherein gravity holds the door in the open position.

19. The lighting fixture of claim 11, wherein the door is approximately one-half of front surface area of the lighting fixture.

20. A lighting fixture, comprising:

a housing defining a mounting access compartment and at least one mounting feature accessible from within the mounting access compartment, the at least one mounting feature selectively configurable for securing the housing to a mounting surface, the mounting access compartment defining an opening allowing user access to the at least one mounting feature;

a door pivotally mounted to the housing; and a light source mounted to an external surface of the housing;

wherein the door is movable relative to the light source and housing between a closed position and an open position, wherein in the closed position the door covers the opening to the mounting access compartment, wherein in the open position the door allows user access to the at least one mounting feature in the mounting access compartment.

* * * * *